US007607476B2

(12) United States Patent
Tom et al.

(10) Patent No.: US 7,607,476 B2
(45) Date of Patent: Oct. 27, 2009

(54) EXPANDABLE SLIP RING

(75) Inventors: Andy Tom, Houston, TX (US); James M. Fraser, Spring, TX (US); John L. Baugh, College Station, TX (US)

(73) Assignee: Baker Hughes Incorporated, Houston, TX (US)

( * ) Notice: Subject to any disclaimer, the term of this patent is extended or adjusted under 35 U.S.C. 154(b) by 367 days.

(21) Appl. No.: 11/402,077

(22) Filed: Jul. 7, 2006

(65) Prior Publication Data

US 2008/0047704 A1 Feb. 28, 2008

(51) Int. Cl.
*E21B 23/00* (2006.01)

(52) U.S. Cl. ..... 166/207; 166/380; 166/384

(58) Field of Classification Search ..... 166/380, 166/384, 207

See application file for complete search history.

(56) References Cited

U.S. PATENT DOCUMENTS

| | | | | |
|---|---|---|---|---|
| 4,311,196 | A * | 1/1982 | Beall et al. | 166/134 |
| 4,440,223 | A * | 4/1984 | Akkerman | 166/217 |
| 5,299,644 | A | 4/1994 | Eckert | |
| 6,454,493 | B1 | 9/2002 | Lohbeck | |
| 6,715,560 | B2 | 4/2004 | Doane et al. | |
| 6,722,427 | B2 * | 4/2004 | Gano et al. | 166/217 |
| 6,793,022 | B2 | 9/2004 | Vick et al. | |
| 7,086,476 | B2 * | 8/2006 | Johnson et al. | 166/380 |
| 7,306,034 | B2 | 12/2007 | Garcia | |
| 7,341,110 | B2 | 3/2008 | Doane et al. | |
| 7,387,170 | B2 | 6/2008 | Doane et al. | |
| 7,493,945 | B2 | 2/2009 | Doane et al. | |

FOREIGN PATENT DOCUMENTS

| | | | |
|---|---|---|---|
| WO | 9842947 | A1 | 10/1998 |
| WO | 9923354 | A1 | 5/1999 |
| WO | 02075107 | A1 | 9/2002 |
| WO | 2005005772 | A1 | 1/2005 |

* cited by examiner

*Primary Examiner*—Jennifer H Gay
*Assistant Examiner*—Robert E Fuller
(74) *Attorney, Agent, or Firm*—Steve Rosenblatt

(57) ABSTRACT

An expandable slip ring is used to secure attachment of an expanded tubular to a surrounding tubular. It features elongated generally axially oriented openings separated by narrow segments. As a swage is advanced within a tubular that has the slip ring outside it the narrow segments or tabs expand and can break but the ring is still held to its shape as the expansion progresses due to the integrity of other tabs that can subsequently break as the swage advances within the tubular that is surrounded by the slip ring. The integrity of the slip ring is enhanced for storage and run in while the expansion characteristics are more uniform as the ring retains some structural integrity during much of the expansion process.

19 Claims, 2 Drawing Sheets

EXPANDABLE SLIP RING

FIELD OF THE INVENTION

The field of the invention is rings that are expanded with a tubular into a surrounding tubular for support.

BACKGROUND OF THE INVENTION

Strings of tubulars are frequently supported from surrounding tubulars already run into the wellbore. One way to do that is to set a packer with slips that bite the surrounding tubular and a seal assembly to seal the annular space. Another way to do this is to expand the smaller tubular into a larger surrounding tubular into which it has been run. When so doing, a slip ring delivered on the smaller tubular is employed. As the smaller tubular is expanded, the slip ring is expanded as well until the slip ring contacts the surrounding tubular. At that time the slip ring can get a bite into the surrounding tubular to enhance the connection and to increase the support capacity of the connection.

Prior slip ring designs involved cylindrical shapes that were an open undulating structure of spaced axially oriented elements connected at their opposed ends and defining axially oriented gaps on either side of the axially oriented elements. This made the resulting structure very flexible. It was considered that flexibility was desired in that the resistance to expansion when the tubular within was expanded was kept to a minimum. While that was true, there were other issues with such a design. One issue was structural integrity during storage, when no pipe extended through the slip ring, and later on when running the slip ring into the well on a tubular. The built in flexibility of the prior design proved to be a detriment in those situations. The slip ring could be easily deformed in storage or during run in due to it flexible shape. Another issue was the behavior of the slip ring during expansion. Due the flexible nature of the design, as the tubular inside was expanded with a swage the growth in dimension of the slip ring was irregular resulting in unsymmetrical contact with the surrounding tubular as the swage was advanced. A swage can also be any cone or likewise device designed for expanding a tubular. This tendency of irregular expansion decreased the support capability of the connection after expansion and in extreme situations prevented a fluid tight connection from occurring.

Accordingly what is needed is a slip ring design that is stronger without unduly increasing the expansion force in a tubular that it surrounds while at the same time having more predictable expansion characteristics to enhance the quality and/or capacity of the attachment. These and other features will be described in greater detail in the discussion of the preferred embodiment below as further explained by the associated figures with the appended claims defining the scope of the invention.

An example of flexible rings that can contract due to compression of axial notches is shown in U.S. Pat. No. 5,299,644. Another example of a notched anchor ring that is intended to break into segments at the onset of expansion is illustrated in U.S. Pat. No. 6,793,022.

SUMMARY OF THE INVENTION

An expandable slip ring is used to secure attachment of an expanded tubular to a surrounding tubular. It features elongated generally axially oriented openings separated by narrow segments. As a swage is advanced within a tubular that has the slip ring outside it the narrow segments or tabs expand and can break but the ring is still held to its shape as the expansion progresses due to the integrity of other tabs that can subsequently break as the swage advances within the tubular that is surrounded by the slip ring. The integrity of the slip ring is enhanced for storage and run in while the expansion characteristics are more uniform as the ring retains some structural integrity during much of the expansion process.

DETAILED DESCRIPTION OF THE PREFERRED EMBODIMENT

Figure 1:
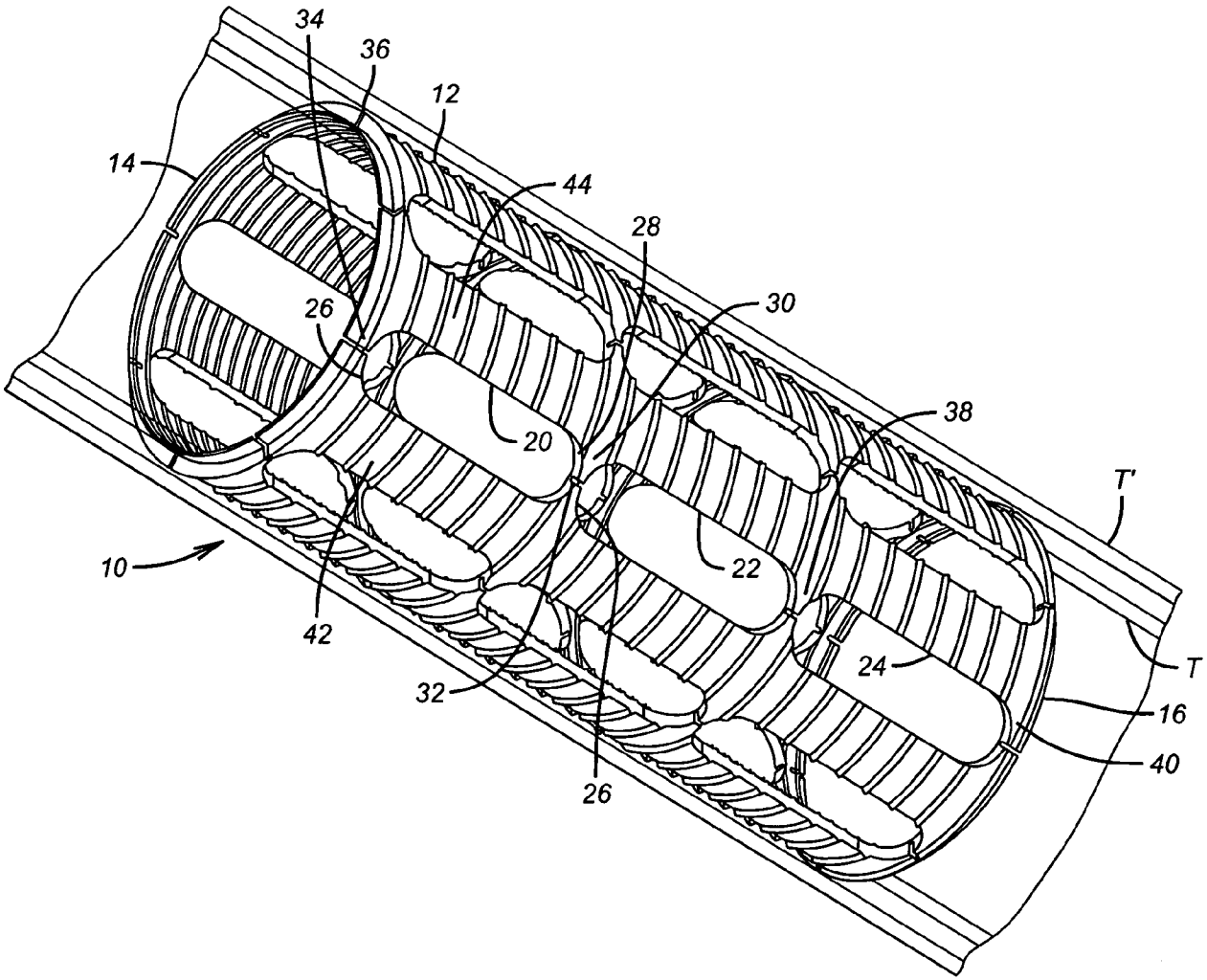
FIG. 1 is a perspective of the slip ring.
Figure 2:
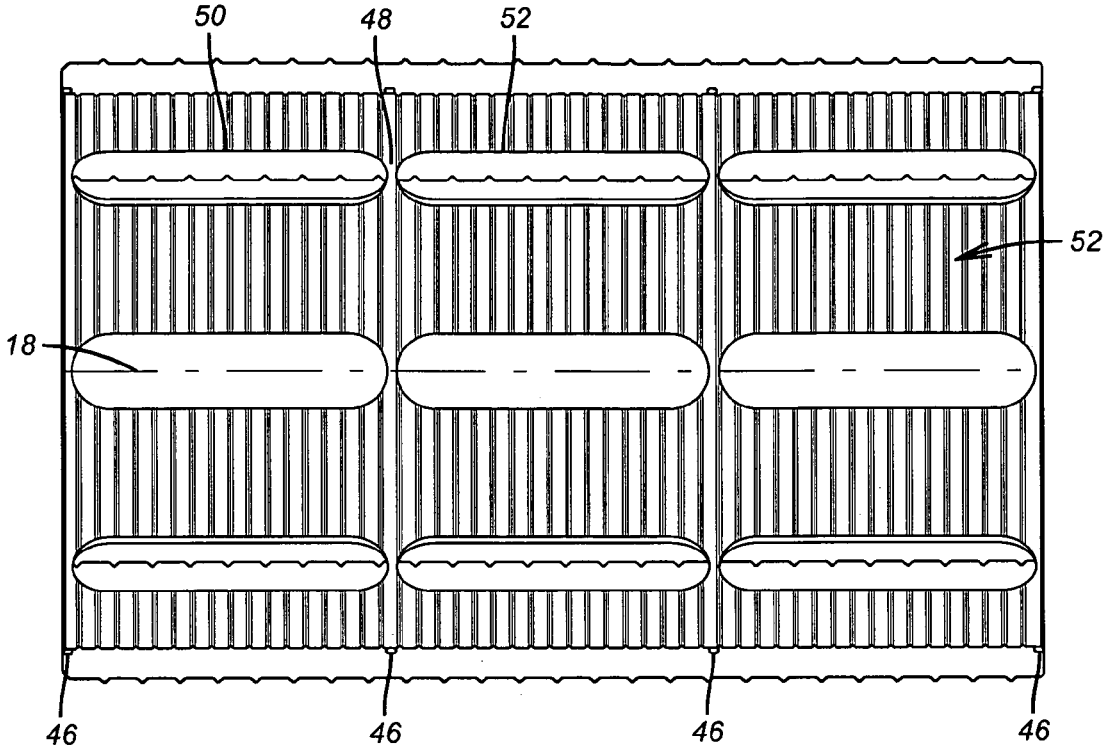
FIG. 2 is an elevation view of another embodiment.

FIG. 1 shows a unitary, or made of one piece, slip ring 10 in perspective. It features external serrations 12 that are shown as a series of axially spaced rings but other patterns can be used to enhance grip or even random distribution of projections that act as grip enhancers without departing from the invention. The slip ring 10 has opposed ends 14 and 16. A longitudinal axis 18 is shown in the embodiment of FIG. 2. As shown in FIG. 1 a series of openings 20, 22 and 24 are preferably generally aligned with each other in rows and with longitudinal axis 18. Each opening such as 20 is preferably axially aligned and circumferentially spaced from the other openings 20. In the preferred embodiment the openings are equally spaced circumferentially at a given axial location. In the preferred embodiment the other openings 22 and 24 are similarly oriented with regard to like openings adjacent to them. The openings are preferably elongated slots with rounded ends such as 26 and 28 at opposed ends of each opening. While there are three openings 20, 22 and 24 illustrated, other numbers in generally aligned rows are also contemplated. Between rounded ends 26 and 28 are narrow segments 30 that optionally can further feature notches 32 to further weaken them. The operation of the slip ring 10 when expansion occurs from end 14 to end 16 is such that narrow segment 34 will spread first under an expansion force. Segments 34 being at an end can be cut clean through or simply notched at 36 or some combination around the circumference, recognizing that the preferred embodiment has the narrow segments 36 of uniform strength so they will all break or separate at nearly the same rate and at nearly the same time. However when that happens the narrow segments 30, 38 and 40 will still be intact so that the dimensional growth of the slip ring 10 as a swage advances through a tubular that it is mounted to (not shown) is more predictable and uniform. The desired effect is that as the swage advances axially, the segments break with the advancements of the swage so that some structural integrity of the slip ring 10 is maintained during the expansion process. Thus thin segments break in the following order when the expansion progresses from end 14 to end 16: 34, 30, 38, and 40. The reverse order is achieved if the expansion is in the opposite direction.

The overall structure is sounder than the prior designs described above when the slip ring 10 is in storage and not mounted to a tubular or when it is on a tubular and run in the hole. As a result, it is less likely to deform or get damages in storage or during run in. Whereas the prior designs provided resistance to hoop stresses circumferentially only near the opposed ends and only on an alternating basis at opposed ends of elongated elements, the design of FIG. 2 has resistance to hoop stresses along several axially displaced locations between what could be considered elongated elements such as 42 and 44. As a result, the structural integrity is enhances while in storage or during run in but the resistance to expansion is not significantly increased while attaining the benefit of more uniform expansion as the swage is advanced within a tubular T on which the slip ring 10 is mounted to connect it to an outer tubular T'. While a symmetrical design of elongated slots is illustrated, other opening shapes and arrangements are contemplated if they produce the result of at least retaining part of the integrity of the structure of ring 10 as the expansion takes place. In essence, there need to be narrow or weaker segments properly situated to reduce expansion resistance while leaving the ring 10 some strength to retain its cylindrical shape during storage and run in. FIG. 1 shows using narrow segments and also optionally adding notches like 32.

Figure 3:
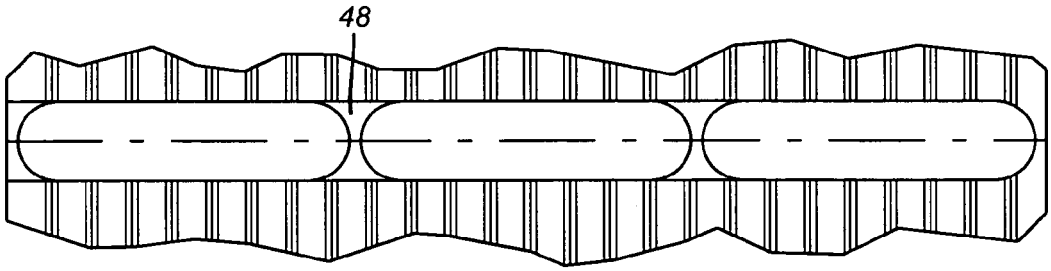
FIG. 3 is a plan view of one row of slots showing the tabs of FIG. 2.

Other alternatives are seen in FIGS. 2 and 3. Unlike FIG. 1 they are not unitary. FIG. 2 shows half a cylindrical shape that can be held to a mating half with tabs 46 that are preferably aligned axially with narrow segments such as 48 that are for example between elongated slots 50 and 52. The tabs can be of the same or different material than the segments they hold together and can be designed to break at close to the same degree of expansion as the narrow segments 48. As with the variations discussed with regard to FIG. 1 the same discussion applied to the design of FIGS. 2 and 3. Tabs 46 can be integral or mounted to a half section 52 by mechanical, chemical welding or other techniques. They can be an overlay on the inside or outside of the half section 52 or abutting its end. Narrow segments such as 48 in FIG. 2 can also be notched or otherwise weakened, as is illustrated in FIG. 1. This can be applied to some narrow segments or all of them.

While the breaking of the narrow segments 34, 30, 38 and 40 during expansion is contemplated, an elongation without physical disconnection at some to all of said locations is also possible as an alternative. In this respect, the material will stretch within its elastic limit and could experience some plastic deformation short of a physical break.

The above description is illustrative of the preferred embodiment and many modifications may be made by those skilled in the art without departing from the invention whose scope is to be determined from the literal and equivalent scope of the claims below:

We claim:

1. A slip ring assembly for supporting an expanded inner tubular against an outer tubular, comprising:

said inner tubular having an outer surface and defining an inner passage from which expansion increases the dimension of said outer surface;

a swage acting in said passage to increase the dimension of said outer surface;

said outer tubular having an inner surface surrounding said inner tubular;

a generally cylindrical body having upper and lower ends and a longitudinal axis and mounted to said outer surface of said inner tubular to increase in dimension therewith, said body comprising a plurality of elongated members generally aligned with said longitudinal axis and circumferentially spaced apart;

connectors to connect adjacent said elongated members to each other at a plurality of spaced apart axial locations;

at least one of said connectors break when said body is increased in radial dimension before said body engages said inner surface of said outer tubular to support said inner tubular against said outer tubular.

2. The assembly of claim 1, comprising:

openings defined by said connectors.

3. The assembly of claim 1, wherein:

said connectors comprise an elongated shape.

4. The assembly of claim 1, wherein:

at least one of said connectors stretch without breaking when said body is increased in radial dimension.

5. The assembly of claim 4, wherein:

said connectors stretch in series as the radial dimension of said body is increased in either axial direction between said upper and lower ends.

6. The assembly of claim 1, wherein:

said connectors break in series as the radial dimension of said body is increased in either axial direction between said upper and lower ends.

7. The assembly of claim 1, wherein:

said connectors between two elongated members are longitudinally aligned.

8. The assembly of claim 1, wherein:

said connectors further comprise a notch.

9. The assembly of claim 1, wherein:

said openings comprise elongated slots with rounded ends.

10. The assembly of claim 1, wherein:

said openings are identically shaped.

11. The assembly of claim 1, wherein:

said openings are disposed in rows generally aligned with said longitudinal axis and further being uniformly spaced circumferentially.

12. The ring of claim 1, wherein:

said body comprises at least two part-cylinder segments joined together with tabs.

13. The ring of claim 12, wherein:

said tabs are axially aligned with said connectors.

14. The ring of claim 13, wherein:

said tabs are integral to said segments.

15. The ring of claim 13, wherein:

said tabs are separately formed from said segments and attached thereto.

16. The ring of claim 13, wherein:

said tabs break in series as the radial dimension of said body is increased in either axial direction between said upper and lower ends.

17. The ring of claim 13, wherein:

said tabs stretch in series as the radial dimension of said body is increased in either axial direction between said upper and lower ends.

18. The assembly of claim 1, wherein:

said ring is unitary.

19. The assembly of claim 1, wherein:

said elongated members continue to be retained in their circumferential spacing by fewer connectors as radial dimensional increase of said body progresses the length of said body.

* * * * *